US006298992B1

(12) United States Patent
Tsao

(10) Patent No.: US 6,298,992 B1
(45) Date of Patent: Oct. 9, 2001

(54) FOLDABLE FOOD-AND-BEVERAGE CARRYING DEVICE

(76) Inventor: Chung-Piao Tsao, 4F, No. 22, Lane 346, Kuang-Fu S. Road, Taipei (TW)

( * ) Notice: Subject to any disclaimer, the term of this patent is extended or adjusted under 35 U.S.C. 154(b) by 0 days.

(21) Appl. No.: 09/656,231

(22) Filed: Sep. 6, 2000

(51) Int. Cl.[7] ..... B65D 71/00

(52) U.S. Cl. ..... 206/549; 206/194; 206/485; 229/117.14

(58) Field of Search ..... 206/142, 167, 206/170, 175, 194, 197, 476, 485, 485.1, 486, 487, 499, 549, 427, 430, 429, 434; 229/87.04, 117.14; 294/87.2

(56) References Cited

U.S. PATENT DOCUMENTS 4,164,286 * 8/1979 Sutherland ..... 206/434
4,570,795 * 2/1986 Sanz ..... 206/430
5,052,552 * 10/1991 Maroszek ..... 206/427
5,127,519 * 7/1992 Tsao ..... 206/142
5,803,264 * 9/1998 Gersten et al. ..... 206/549
5,957,276 * 9/1999 Cutler et al. ..... 206/194

* cited by examiner

*Primary Examiner*—Luan K. Bui

(57) ABSTRACT

A foldable carrying device includes a base member having a bottom hole formed in the base member for inserting therein a food container stored with roasted or baked foods or other foods, and two handle members formed on opposite ends of the base member and interlockable for portable use, each handle member having a fastener directly cut out from the handle member, whereby upon interlocking of the two handle members to allow the fastener to fasten a beverage cup (or container) which is loaded on the food container, the beverage cup as stacked on the food container will be simultaneously carried compactly and conveniently.

4 Claims, 6 Drawing Sheets

FOLDABLE FOOD-AND-BEVERAGE CARRYING DEVICE

BACKGROUND OF THE INVENTION

U.S. Pat. No. 5,267,644 issued to the same inventor of this application disclosed a tuckable carrier having a plurality of holes formed in a base portion of the carrier for inserting a plurality of beverage or food containers in the holes, and two handle portions formed on opposite sides of the base portion for portable use. However, the beverage container (cup) can not be superimposed on the food container for saving space. It requires a larger area for "accommodating" the beverage containers and food containers on the base portion of the carrier, thereby consuming much paper board and causing inconvenience for carrying the carrier with larger area.

The present inventor has found the drawbacks of the prior art and invented the foldable carrying device for convenient carrying.

SUMMARY OF THE INVENTION

The object of the present invention is to provide a foldable carrying device includes a base member having a bottom hole formed in the base member for inserting therein a food container stored with roasted or baked foods or other foods, and two handle members formed on opposite ends of the base member and interlockable for portable use, each handle member having a fastener directly cut out from the handle member, whereby upon interlocking of the two handle members to allow the fastener to fasten a beverage cup (or container) which is loaded on the food container, the beverage cup as stacked on the food container will be simultaneously carried compactly and conveniently.

DETAILED DESCRIPTION

Figure 1:
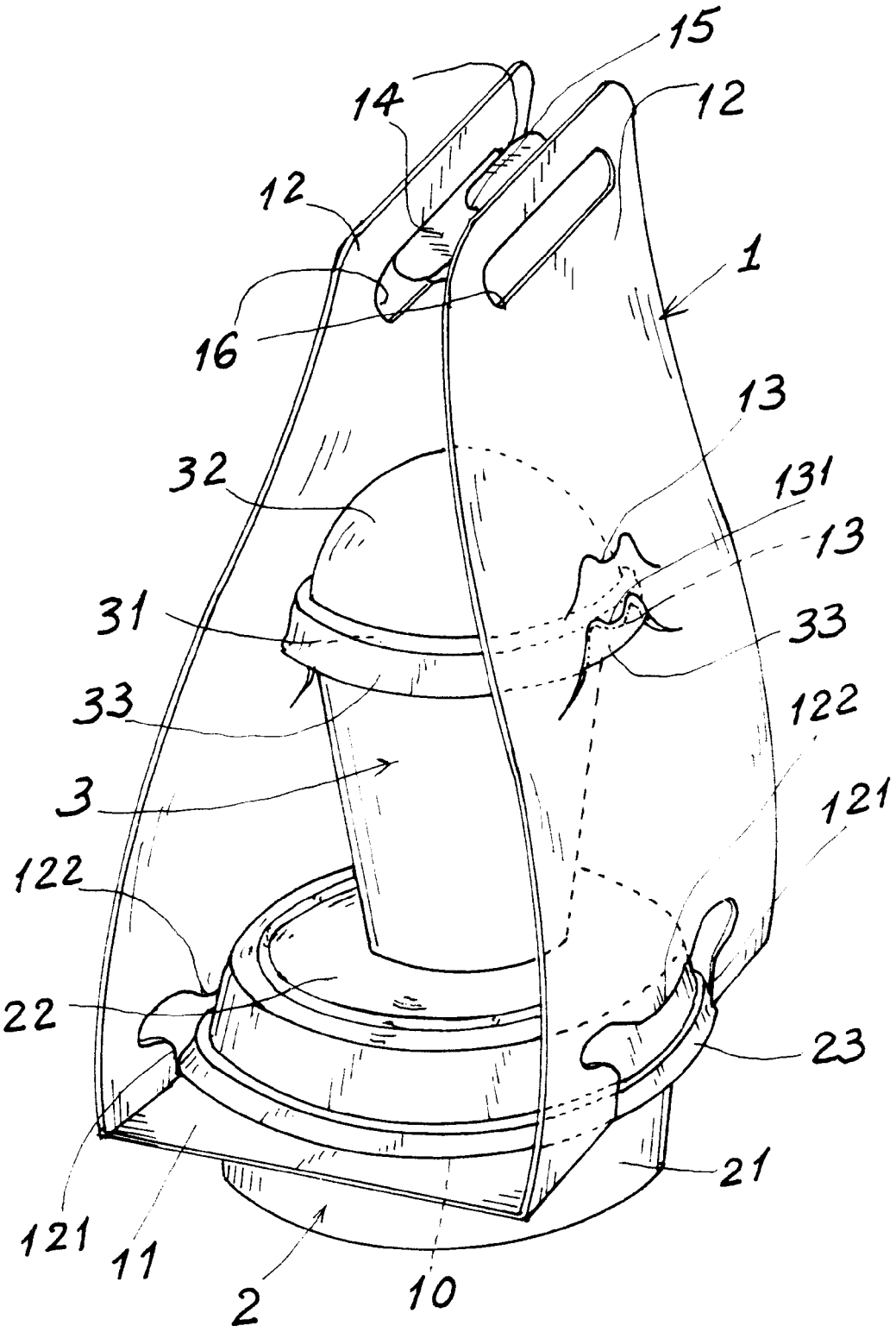
FIG. 1 is a perspective view of the present invention.

As shown in FIGS. 1~4, the foldable food-and-beverage carrying device 1 of the present invention comprises: a base member 11 having a bottom hole (or opening) 10 formed in the base member 11 for inserting a food container 2 in the hole 10, a pair of handle members 12 formed on opposite ends of the base member 11 and interlockable to serve as a handle for carrying purpose, each handle member 12 having at least a fastener means 13 formed thereon and adapted for fastening or holding a beverage container or cup 3 which is loaded or stacked on the food container 2 when engaged in the bottom hole 10, and a pair of flaps 14 cut out from the two handle members 12 and interlocked each other for coupling the two handle members 12 for handling.

The carrying device 1 may be cut out from a one-piece paper or plastic board or any other sheet materials. The bottom hole 10 is preferably formed as a circular shape, but not limited in this invention.

Figure 2:
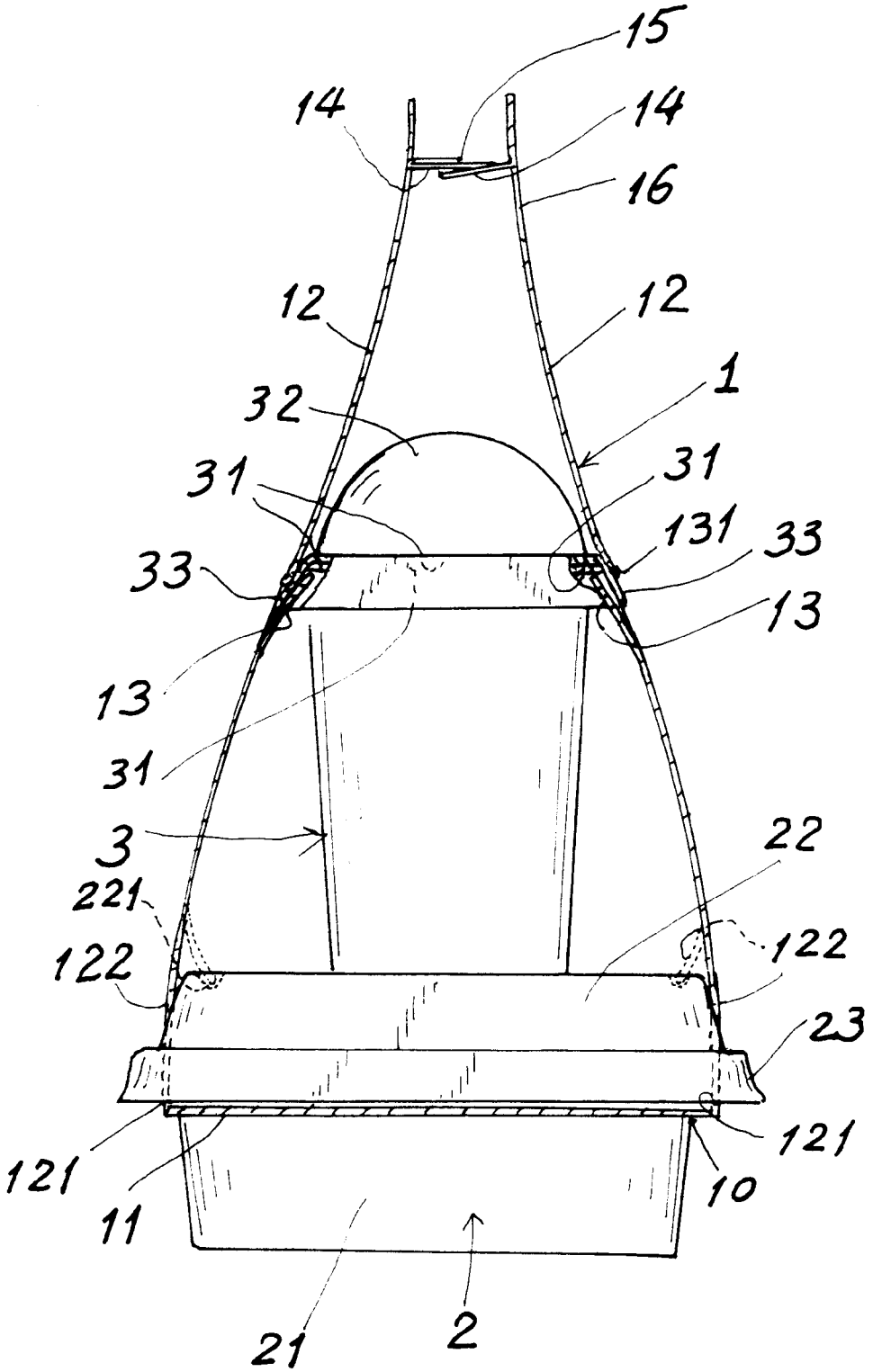
FIG. 2 is a side view of FIG. 1.
Figure 3:
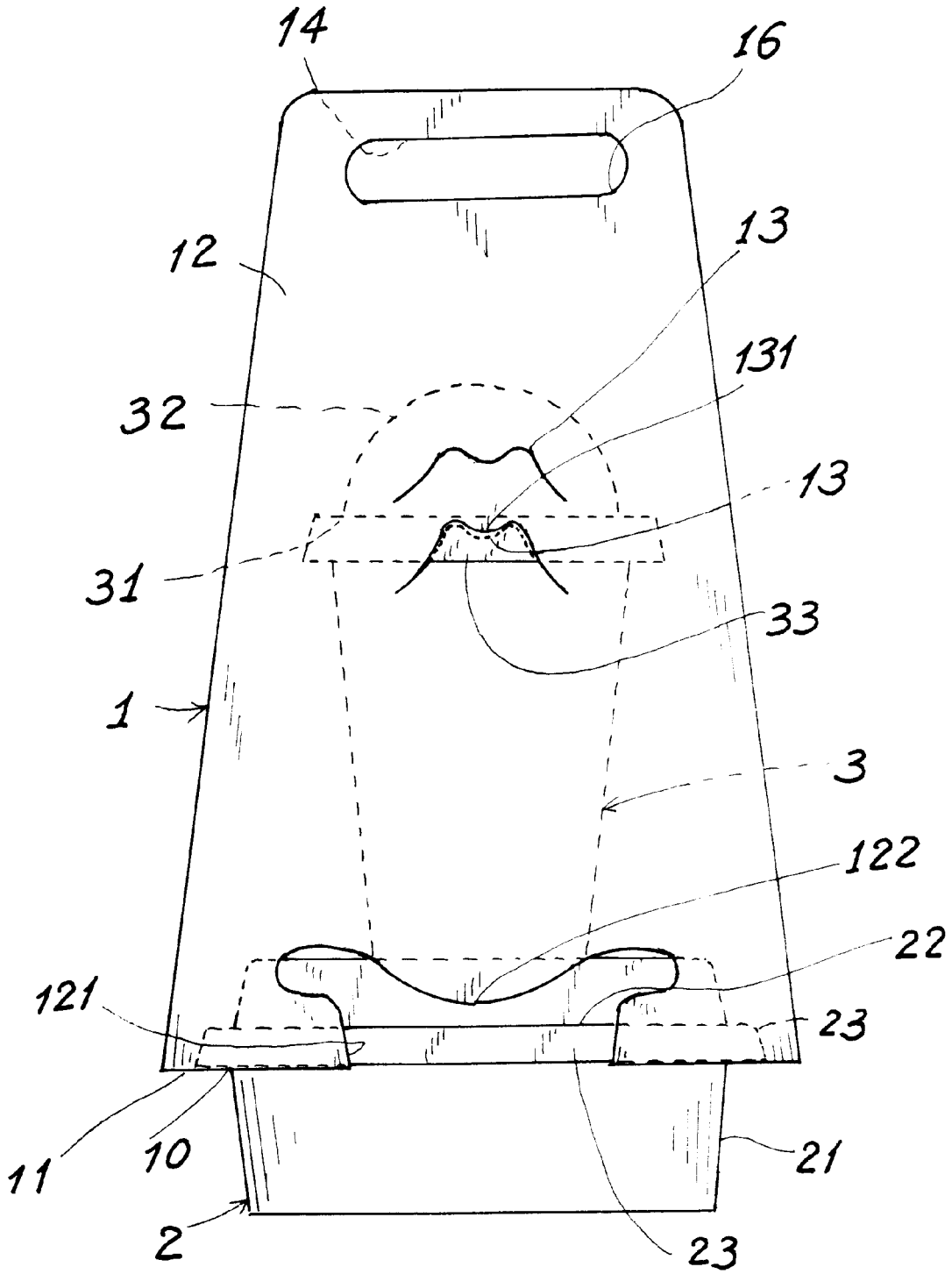
FIG. 3 is a front view of FIG. 1.
Figure 4:
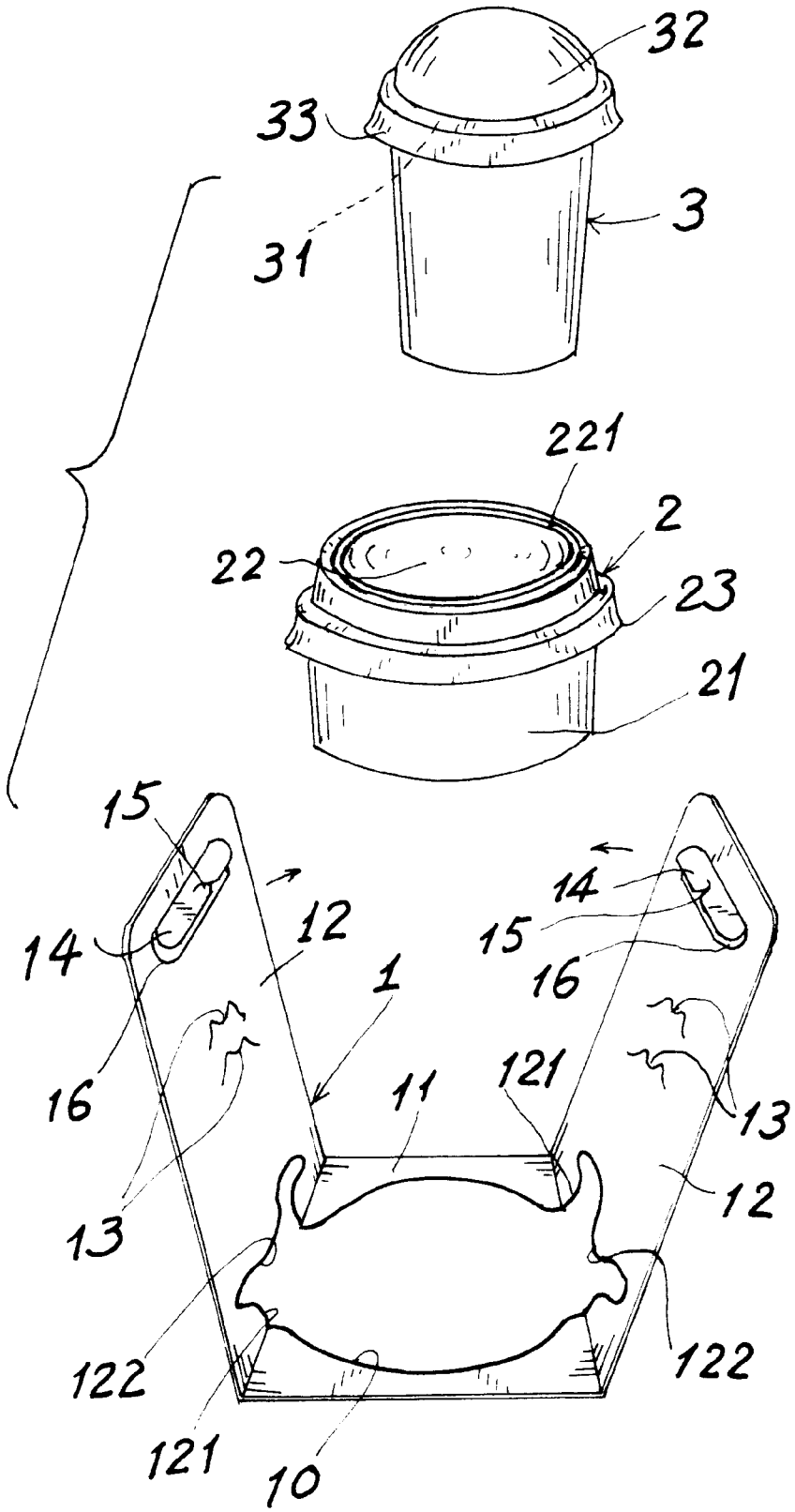
FIG. 4 shows the present invention as unfolded.

Each handle member 12 is directly folded from one end of the base member 11 so that two handle members 12 are folded and interlocked as shown in FIGS. 1~3 for carrying the food container 2 having roasted or baked foods or other foods stored therein and also for simultaneously carrying the beverage cup or container 3 which is stacked or loaded on the food container 2. The beverage container 3 may be provided for filling coffee, cola, or other drinks therein.

The food container 2 includes a cylindrical (or formed as other shapes) member 21 engageable with the bottom hole 10 formed as circular shape or other shapes, a top cover 22 having a flat top surface and having a flange 23 circumferentially formed on a rim of the top cover 22.

Each handle member 12 is formed with a bottom slot 121 in its bottom portion to be communicated with the bottom hole 10 for engaging and holding the flange 23 of the food container 2, and also formed with a tab 122 on a lower portion of the handle member 12 above the bottom slot 121 for retaining the top cover 22 of the food container 2 when engaged in the bottom hole 10 of the base member Each handle member 12 includes a plurality of lugs 13 juxtapositionally cut out in the handle member, whereby when two said lugs 13 are bent inwardly (FIG. 2) from the two handle members 12 when interlocked for portable use, the beverage container 3, preferably formed as cylindrical or conical shape, will be held, fastened or clamped by the two lugs 13 as inwardly protruded from the two handle members 12. After inwardly bending each lug 13 to hold the beverage cup 3, a cut-out edge portion 131 corresponding to the lug 13 will help retain or limit the beverage container as shown in FIGS. 1~3 to be stably stacked on the food container 2.

The beverage container 3 includes an annular extension ring 31 formed on an upper rim of the container 3 generally cylindrical shaped, a top cover 32 having a flange 33 circumferentially formed on a perimeter of the top cover 32 and engageable with the extension ring 31 for closing the container 3.

When interlocking the two handle members 12 as shown in FIGS. 1, 2, the two lugs 13 are bent inwardly to insert each lug 13 within the flange 33 of the top cover 32 of the container 3 to retain the annular extension ring 31 of the container 3, thereby firmly fastening (or supporting) the beverage container or cup 3 between the two handle members 12 in order to be stably loaded on the food container 2.

Figure 5:
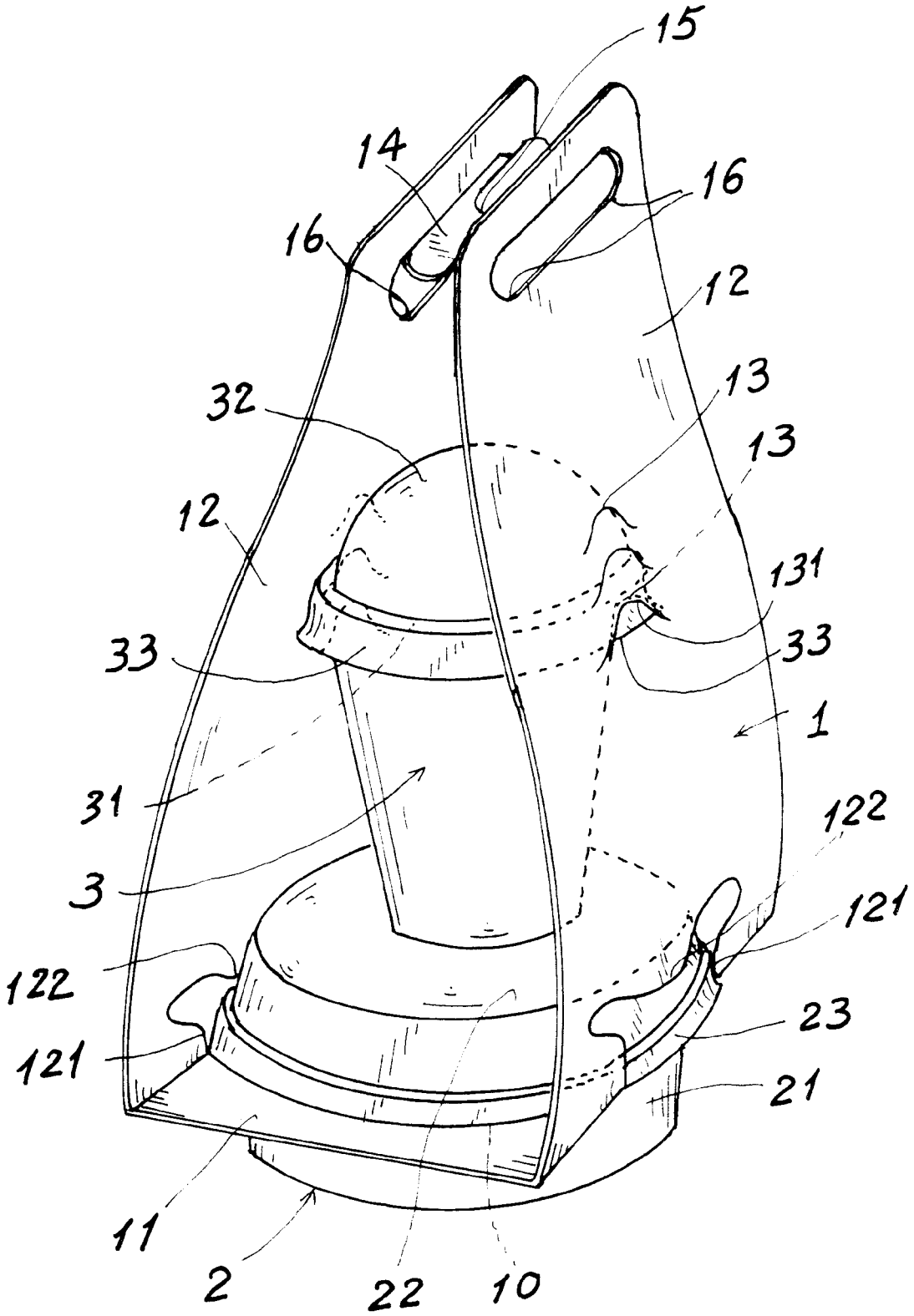
FIG. 5 shows another preferred embodiment of the present invention.

The lug 13 may be formed as an inversed W shape (FIGS. 1~4) or V shape (FIG. 5), but not limited in this invention. The cut-out edge portion 131 of each lug 13 may help retain the flange 33 of the beverage container 3 to be stably held between the two handle members 12 and on the food container 2.

The lugs 13 formed on the handle members 12 may be defined as a "fastener means" for fastening the beverage container or cup 3 between the two handle members 12.

The lugs 13 as juxtapositionally cut out in the handle member 12 are vertically aligned and equally spaced allowing an adjustable holding of the beverage container 3 by each pair of lugs 13 at different heights.

Figure 6:
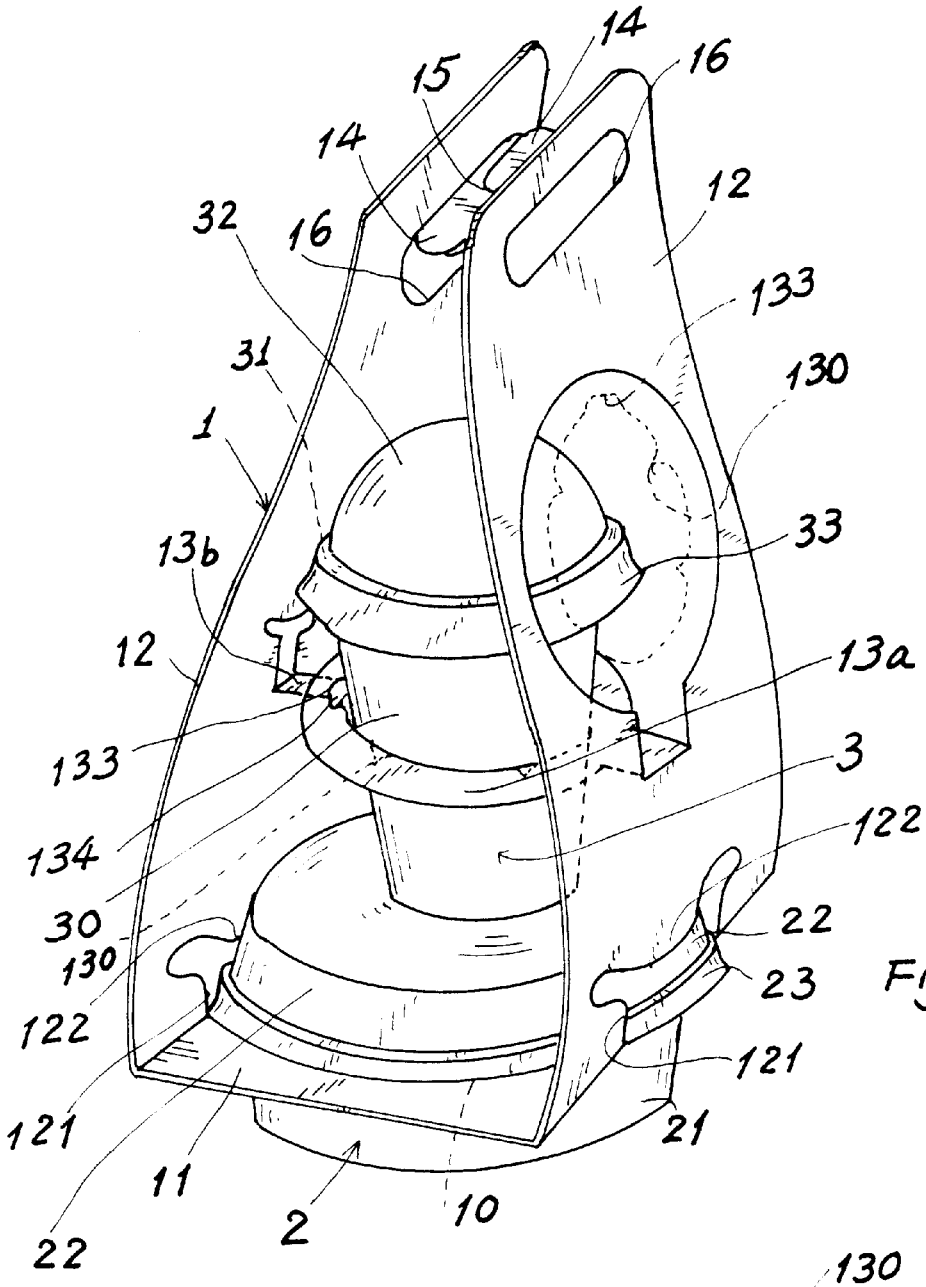
FIG. 6 shows still another preferred embodiment of the present invention.
Figure 7:
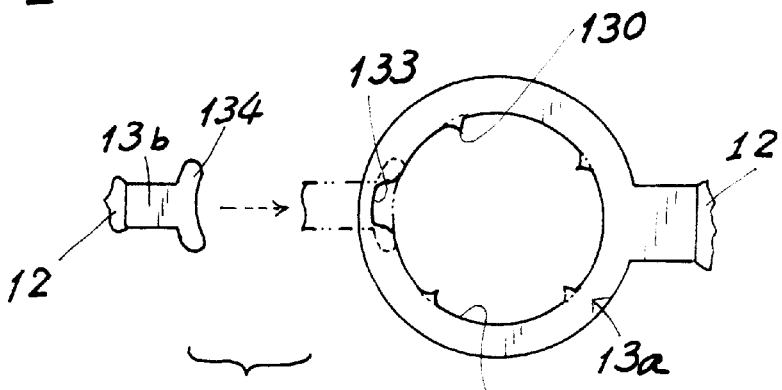
FIG. 7 is an illustration showing the coupling of a fastener means adapted for fastening the beverage cup in accordance with the present invention.

The lugs 13 as aforementioned may be modified to be a fastening loop 13*a* as shown in FIGS. 6, 7.

The fastening loop 13*a* is directly cut out from a handle member 12, having a ring member 132 generally circular shaped for engaging a cylindrical or conical casing 30 of the beverage container 3. The ring member 132 may be further formed with a plurality of teeth 130 radially protruded inwardly from the ring member 132 to help hold the beverage container 3 within the ring member 132. For holding beverage container with larger diameter, the teeth 130 may be bent downwardly as shown in dotted line of FIG. 7 to engage the cylindrical casing 30 with the inside diameter of the ring member 132.

A coupling latch 13*b* may be directly cut out from a left-side handle member 12 and is formed with a latch member 134 in order to be engaged with a recess 133 notched in the ring member 132 formed on a right-side handle member 12 as shown in FIGS. 6, 7 for firmly coupling and positioning the fastening loop 13*a* between the two handle members 12 for stably holding the beverage container 3 within the fastening loop 13*a*.

For simplifying purpose, the fastening loop 13*a* may be a loop or ring member simply cut out from either side handle member 12 and bent to be horizontally positioned for holding the beverage container 3 in the loop or ring member.

Or, the fastening loop 13*a* may be formed with a hook member (not shown) on the ring member 132 in order to be engaged with a slit as notched on the other handle member so that the fastening loop 13*a* may also be horizontally coupled between the two handle members 12 for fastening the beverage container 3.

Each handle member 12 includes: a flap 14 cut out in the handle member 12 to form a hand hole or finger hole 16, having a locking tab formed on each flap 14 by cutting a slit 15 which may be L shape or T shape as cut in the central portion of the flap 14, whereby upon interlocking of the two flaps 14 by engaging two locking tabs of the two flaps 14, the two handle members 12 will then be combined and interlocked to serve as a handle for easy carrying by passing a user's hand or fingers through the hand (finger) holes 16.

The present invention may be modified without departing from the spirit and scope of the present invention.

I claim:

1. A foldable food-and-beverage carrying device, comprising:

a base member having a bottom opening formed therein for engaging and holding a food container in said bottom opening;

a pair of handle members formed on opposite ends of said base member and operatively folded from said base member to be interlocked for carrying;

each said handle member having at least a fastener means formed thereon for fastening a beverage container, whereby upon interlocking of two said handle members, said beverage container as fastened by said fastener means will be held in between two said handle members to be stably loaded or stacked on said food container; and said fastener means including a fastening loop directly cut out from one said handle member, having a ring member for engaging and holding the beverage container to be loaded on said food container.

2. A carrying device according to claim 1, wherein said ring member is further formed with a plurality of teeth radially protruded inwardly from the ring member to help hold the beverage container within the ring member.

3. A carrying device according to claim 1, wherein said fastener means further includes a coupling latch directly cut out from one said handle member and is formed with a latch member in order to be engaged with a recess notched in said ring member of said fastening loop as formed on the other said handle member for firmly coupling and positioning the fastening loop between the two handle members for stably holding the beverage container within the fastening loop.

4. A carrying device according to claim 1, wherein said fastener means further includes a hook portion formed on said fastening loop as cut out in a first handle member, whereby when horizontally bending said fastening loop from said first handle member, said hook portion will be engaged in a slit as cut in a second handle member for firmly coupling said fastening loop between said first and second handle members for stably holding said beverage container.

* * * * *